US005980201A

United States Patent [19]

Benoist et al.

[11] Patent Number: 5,980,201

[45] Date of Patent: Nov. 9, 1999

[54] DEVICE FOR BLOWING GASES FOR REGULATING CLEARANCES IN A GAS TURBINE ENGINE

[75] Inventors: Josette Benoist, Le Mee S/Seine; Guillaume Henri Chaput, Fontainebleau; Didier Désiré René Pasquiet, Vert Saint Denis; Jean-Claude Christian Taillant, Vaux le Penil; Guy Pierre Queneherve, Bonneuil S/Marne, all of France

[73] Assignee: Societe Nationale d'Etude et de Construction de Moteurs d'Aviation, Paris, France

[21] Appl. No.: 08/877,903

[22] Filed: Jun. 18, 1997

[30] Foreign Application Priority Data

Jun. 27, 1996 [FR] France ..... 96 07978

[51] Int. Cl.[6] ..... F01D 9/62

[52] U.S. Cl. ..... 415/115; 415/116; 415/176; 415/177; 415/178

[58] Field of Search ..... 415/176, 177, 415/178, 115, 116, 136, 173.2; 60/39.75

[56] References Cited

U.S. PATENT DOCUMENTS

| | | | |
|---|---|---|---|
| 4,279,123 | 7/1981 | Griffin et al. | 415/136 |
| 4,512,712 | 4/1985 | Baran, Jr. | 415/116 |
| 4,573,865 | 3/1986 | Hsia et al. | 415/115 |
| 5,064,343 | 11/1991 | Mills | 415/115 |
| 5,100,291 | 3/1992 | Glover | 415/115 |
| 5,399,066 | 3/1995 | Ritchie et al. | 415/115 |

FOREIGN PATENT DOCUMENTS

| | | |
|---|---|---|
| 2 509 373 | 1/1983 | France . |
| 2 688 539 | 9/1993 | France . |
| WO 92/11444 | 7/1992 | WIPO . |

*Primary Examiner*—F. Daniel Lopez
*Assistant Examiner*—Richard Woo
*Attorney, Agent, or Firm*—Oblon, Spivak, McClelland, Maier & Neustadt, P.C.

[57] ABSTRACT

A gas mixer (8) which placed in a flow of gases upstream of a ring (3) that is to be heated or cooled, the gas mixer (8) including a succession of chambers (12, 14, 15) having communication or outlet orifices (16, 17, 18) in large numbers in order to render uniform a rate and temperature of the gas flow. The gas mixer (8) is applicable to gas turbine engines.

14 Claims, 10 Drawing Sheets

DEVICE FOR BLOWING GASES FOR REGULATING CLEARANCES IN A GAS TURBINE ENGINE

DESCRIPTION

BACKGROUND OF THE INVENTION

1. Field of the Invention

The invention relates to a device for blowing gases for regulating the clearances or gaps within a gas turbine engine.

2. Discussion of the Background

For some time it has been an aim to reduce the gaps between rotary and fixed parts of gas turbine engines and more particularly between the ends of blades and the opposing rings of the stator, especially in the turbines, in order to increase the efficiency of the engine, the thrust which it produces and the pumping reserve.

The gaps are variable during the operation of the engine between starting, transient states and the stable state, due to heating and centrifugal forces, which give rise to increasing mechanical and thermal deformations differing between the stator and the rotor. For this reason dynamic clearance regulating devices have already been designed, whereof the most widely used utilize a gas current, tapped from a portion of the engine, such as a compressor, and which circulates behind the stator rings, whereof the diameter is to be regulated. The gas cools or heats the rings, as a function of the engine part from which it comes and produces supplementary thermal deformations bringing said rings to the desired diameter. The extent of such deformations can be regulated with the tapped gas flow rate. Thus, gases can be tapped at several points of the engine and the corresponding channels are successively opened in order to obtain a deformation having the desired value. French patents 2 509 373 and 2 688 539 give a few examples of such configurations.

However, it has been observed that the thermal deformations produced are not always uniform, which can be attributed to a lack of homogeneity of the gas flow along the circumference of the ring, or a lack of temperature uniformity if it comes from several pipes issuing in front of successive ring portions.

SUMMARY OF THE INVENTION

According to the invention, the clearance or gap regulating gases do not issue directly into the chamber defined by the ring passing out of the routing pipes, but instead pass through a mixer.

This mixer comprises a plurality of successive chambers having identical cross-sections and separated by substantially parallel bulkheads or partitions, which have an increasing number of orifices between individual partitions towards the stator ring. This leads to a tree structure flow of the gases between individual chambers, so that they arrive with a considerable temperature and flow rate homogeneity in front of the ring.

The orifices can consist of simple openings made through the chamber separating partitions or can comprise short pipes. In both cases, there is merely a pressure drop which is much smaller than with ordinary routing devices, which generally implies considerable flow disturbances due to large direction or speed variations.

The number of orifices can be in geometrical progression from one partition to the next, e.g. twice more numerous, and they are preferably distributed in circumferential rows in an identical number for all the partitions, so that only the angular spacing varies between neighbouring partitions.

The chambers can be annular and separated by transverse partitions in the gas turbine engine and in ring form. They are then in the form of stacked cylinders. They can also be substantially annular, but separated by cylindrical and concentric partitions. They are then arranged in concentric cylinder form.

The orifices between chambers can be replaced by linking pipes, if the chambers are not contiguous. This design more particularly applies to elongated devices, where the chambers face different portions to be ventilated of the ring and have blowing orifices towards said portions. The interest of arranging more numerous pipes between successive chamber pairs in the direction of the ventilation gas flow remains, but the construction according to the invention can be implemented in a somewhat different manner from the previously described embodiments. It is consequently no longer necessary for the chambers to have the same cross-section if the gas leaks gradually through the orifices therein. It is in fact favourable for their cross-sections to decrease from one chamber to the next in order to maintain a roughly constant speed and pressure. However, it is still appropriate for the chambers to have the same extent, i.e. the same angular extension in the normal case of annular chambers or in ring portion form.

After giving these explanations, it is possible to summarize such constructions according to the invention as being devices for blowing gases into a gas turbine engine extending around at least one stator ring and characterized in that they comprise a plurality of parallel, succeeding chambers, having identical extents, decreasing cross-sections and connected by pipes in increasing numbers from one chamber to the next in a gas flow direction, the chambers having orifices directed onto the stator ring.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
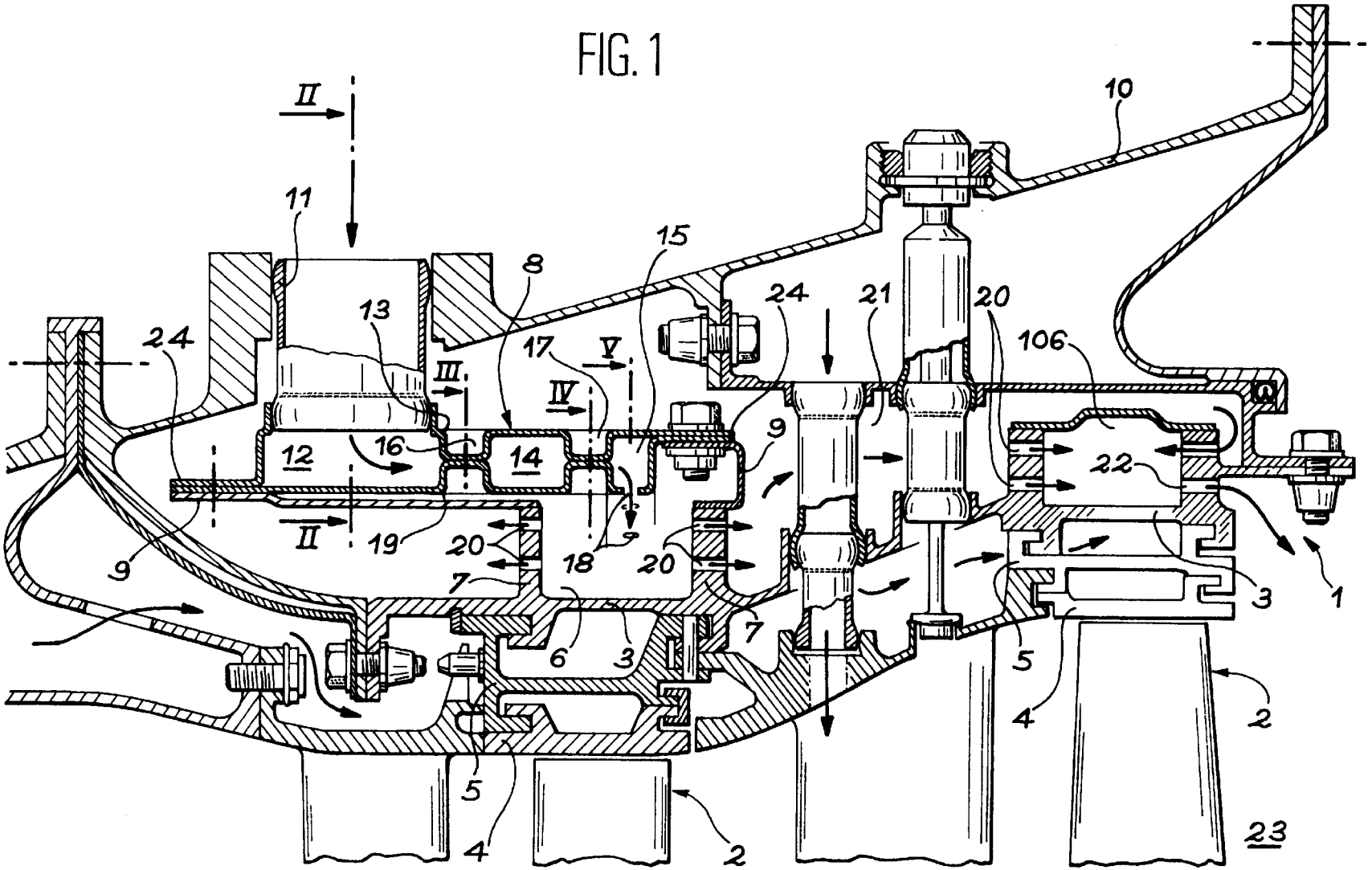
FIG. 1 A longitudinal section of a gas turbine engine portion in which has been installed a construction according to the invention.
Figure 2:
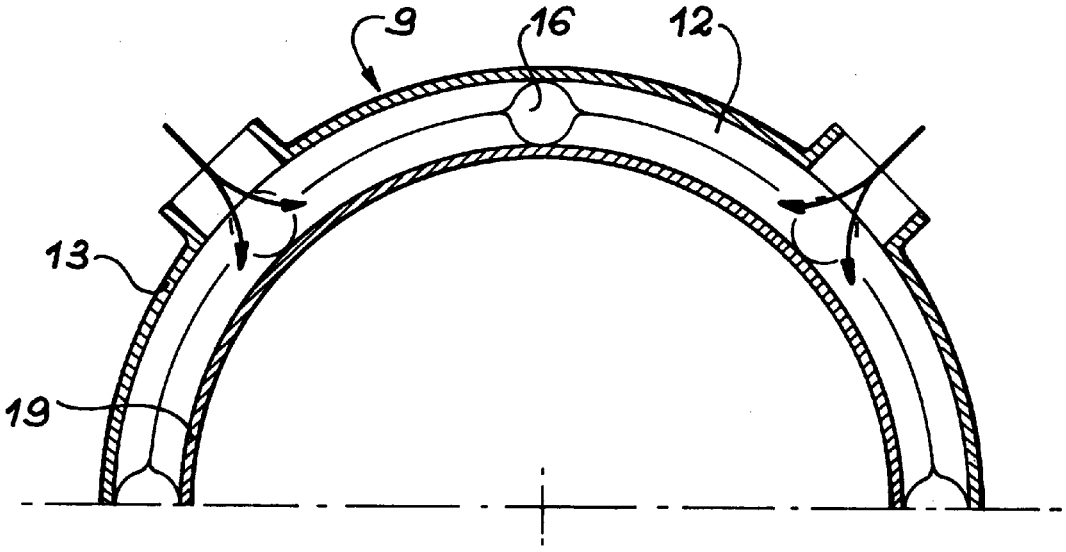
FIGS. 2 to 5 Sections of FIG. 1 along lines II—II to V—V thereof.
Figure 3:
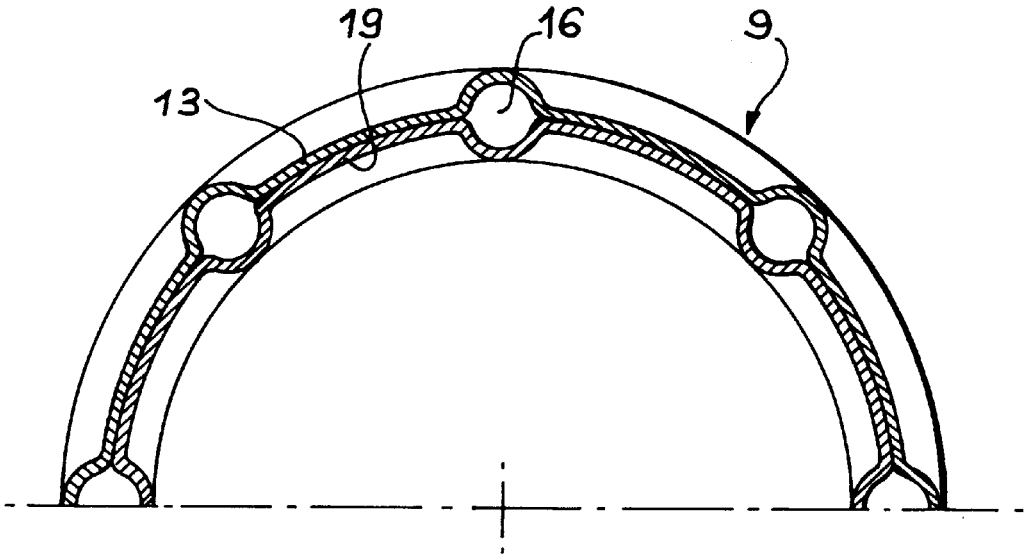
Figure 4:
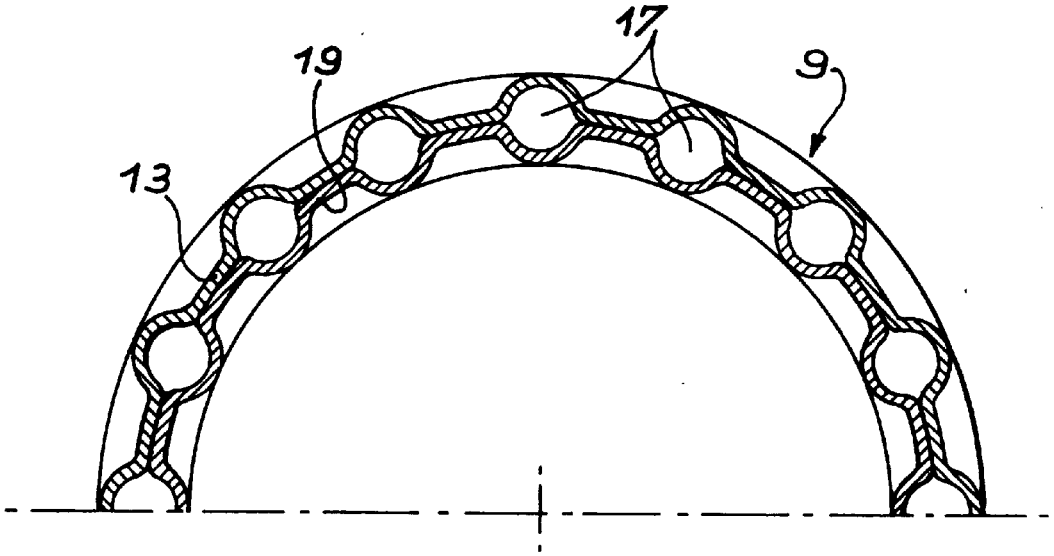
Figure 5:
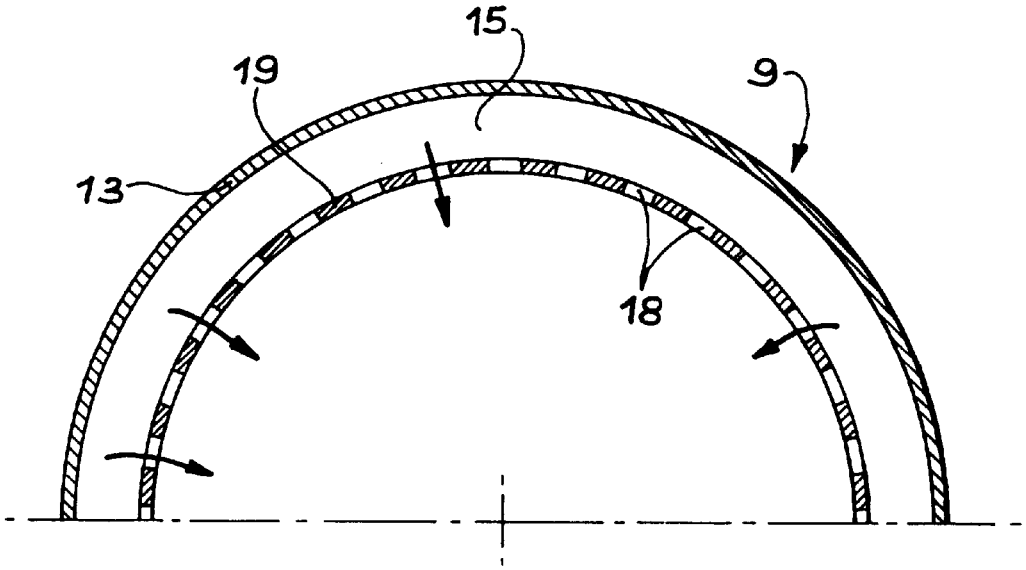

Referring now to the drawings, wherein like reference numerals designate identical or corresponding parts throughout the several views, and more particularly to FIG. 1 thereof, there is illustrated turbine engine portion according to the present invention.

The turbine engine portion shown in the different drawings essentially comprises a stator fragment 1 having, facing two blade stages 2, two rings 3 formed from a substantially cylindrical metal skin and carrying sealing segments 4, positioned just in front of the ends of the blades 2, by means of a fixing ring 5. A chamber 6 or 106 is placed behind each of the rings 3 and two walls 7, in one piece with the ring 3, define the latter also on the sides on FIG. 1.

The mixer 8 according to the invention is annular, closes the outside of one of the chambers 6 and is screwed by its longitudinal ends to two sheets or plates 9 forming extensions of the walls 7. An outer casing ring 10 surrounds and covers the mixer 8. However, it is traversed by four gas supply pipes 11, which lead into a first chamber 12 of the mixer 8. These pipes 11 are arranged at right angles around the engine and only one is shown in FIG. 1.

The gas flows more precisely enter by the outer wall of the mixer 8 and firstly have a centripetal direction on passing out of the pipes 11, before straightening in the first chamber 12 to assume an axial direction. They then penetrate a second chamber 14, followed by a third chamber 15, before leaving the mixer 8 and passing into the first chamber 6 allocated to the regulation of the diameter of the ring 3.

Each of these passages takes place through ever more numerous orifices. Thus, with four pipes 11, there are eight orifices 16 between the first chamber 12 and the second chamber 14, sixteen orifices 17 between the second chamber 14 and the third chamber 15 and thirty two orifices 18 on leaving the third chamber 15, as can be seen in FIGS. 2 to 5, which show half-circumferences of the mixer 8, the remainder being the same.

The orifices 16, 17, 18 are respectively placed around the engine in a single row, so that their angular spacing is on each occasion twice smaller. This renders the flow uniform and leads to a stirring up of the gases, which contributes to equalizing both the flow rate and temperature, i.e. the thermal expansion produced.

For this purpose the chambers 12, 14 and 15 of the mixer 18 and the partitions or bulkheads 16 and 17 separating the same have a regular arrangement, i.e. the chambers have a roughly similar cross-section and the partitions are roughly parallel, so as not to disturb the gas flow, which would lead to pressure drops and would harm the flow uniformity. The third orifices 18 are located on the inner face 19 of the mixer 8, which makes it necessary for the gases to resume a centripetal flow in the third chamber 15, but the uniform nature has by then been established. The gases leave the chamber 6 into which they were blown passing through the orifices 20 traversing the walls 7 and then traverse an intermediate space 21 of the stator 1 before entering the other of the chambers 106 traversing the orifices 20 of said walls 17. One of these walls 17 is provided with other orifices 22 leading into the engine section 23, as a result of which the second chamber 106 is evacuated and the clearance regulating gas tapped beforehand from the section 23 returns thereto.

The mixer 8 can be formed from two circular sheet metal plates, corresponding substantially to the outer 13 and inner 19 faces of the annular chambers 12, 14 and 15 and shaped so as to join at the longitudinal ends and at the partitions 16 and 17, excepting the orifices. These sheets have end edges 24 by which they are screwed to sheets 9 integral with the walls 7.

Figure 6:
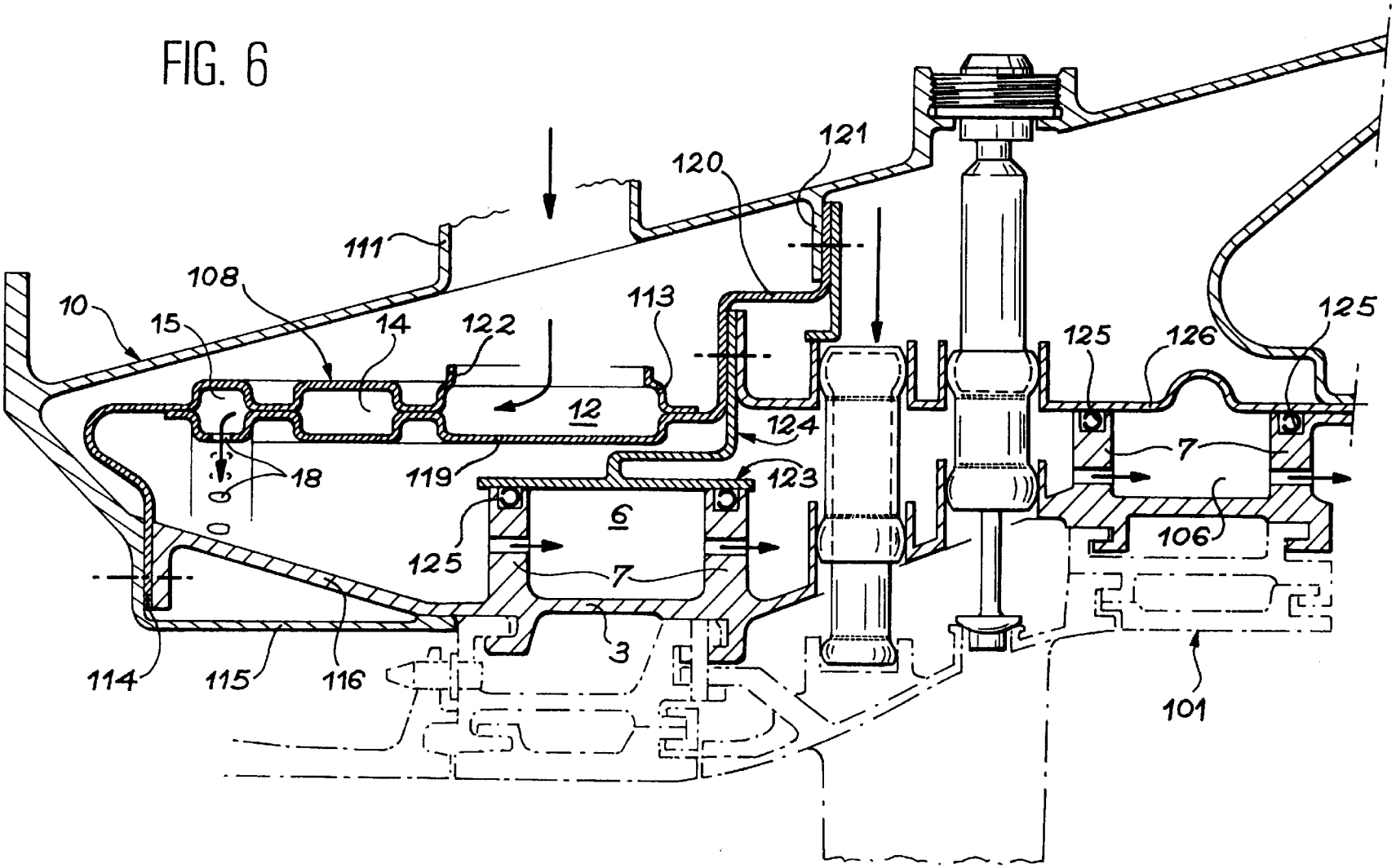
FIG. 6 Another construction.

FIG. 6 shows a largely similar mixer 108, but whose structure, like those of the neighbouring parts, is entirely formed by dismantlable fairings. Thus, the supply pipes 111 lead to the outer casing 10 and are not joined to the mixer 108.

A first fairing 113 forms the outer face, directed towards the outer casing 10, of the mixer 108 and has an inner edge 114 fitted between two flanges 115, 116 of the stator 101, said flanges 115 and 116 being respectively connected to the thermal regulation rings and to the outer casing 10 to form a continuous partition. Another fairing 119 extends concentrically to the first and forms the inner face of the mixer 108 and also has an outer edge 120 screwed to a rib 121 of the outer casing 10.

The volume between the outer casing 10 and the stator 101 and which is occupied by the mixer 108 is divided into two substantially concentric portions by it and in particular by the edges 114 and 120, so that the gases coming from the pipes 111 lead into the outer part of said volume and only leave it by traversing four orifices 122 opposite the pipes 111 and form through the first fairing 113. The orifices 122 open into the first chamber 12 of the mixer 108, whose internal configuration is identical to that of the mixer 8 and which in particular has three successive chambers 12, 14 and 15 from which the gases pass out by the increasing number of orifices.

The third orifices 18 are directed into the other of the portions of the volume containing the mixer 108, in front of one of the walls 7 of one of the heat regulating chambers 6. In this design, the chamber 6 is traversed between the individual walls 7 by a longitudinal, rectilinear gas flow and it is not closed by the mixer 108, but instead by a cylindrical partition 123 of a third fairing 124 screwed to the edge 120 of the first fairing 113. The sealing between the walls 7 and the cylindrical partition 123 is ensured by toroidal metal joints 125 having an open section and a good elasticity, even at high temperatures.

Adjacent fairings can be positioned between the stator 101 and the outer casing 10 in order to guide the clearance regulating gases to the second chamber 106, their form depending on other arrangements located there. The second chamber 106 can in particular be closed by a fairing 126 identical to the cylindrical partition 123 and which contributes to crushing other joints 125 with the walls 7.

Figure 7:
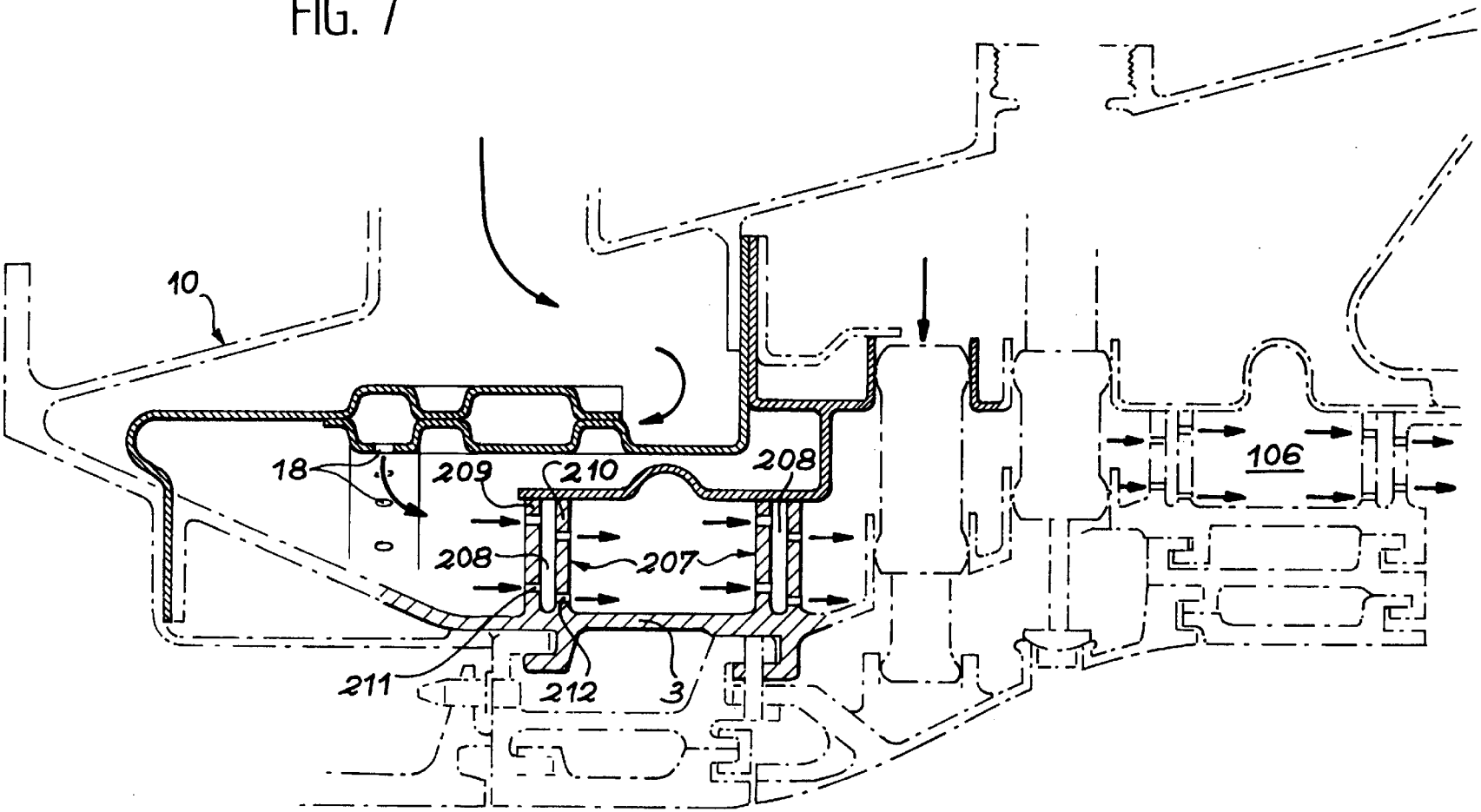
FIG. 7 A third construction.

FIG. 7 illustrates another construction, which more particularly relates to the walls of the chambers designated by the reference 206. These walls have an annular groove 208, so that they are divided into two overlapping thin skins 209, 210. Moreover, the orifices, respectively 211 and 212, which in each case traverse these skins 209, 210 are not in extension, so that the gases have to follow a staggered path extending their stay in the groove 208 and improving the heat exchange with the walls 207 and indirectly with the ring 3. The other arrangements of the invention are unchanged.

It should also be noted that the orifices traversing the walls 107 and 207 can be inclined in the circumferential direction, in order to give the gas flow a helical component extending their stay in the chamber 6 or 106 and consequently improving the heat exchange.

Figure 8:
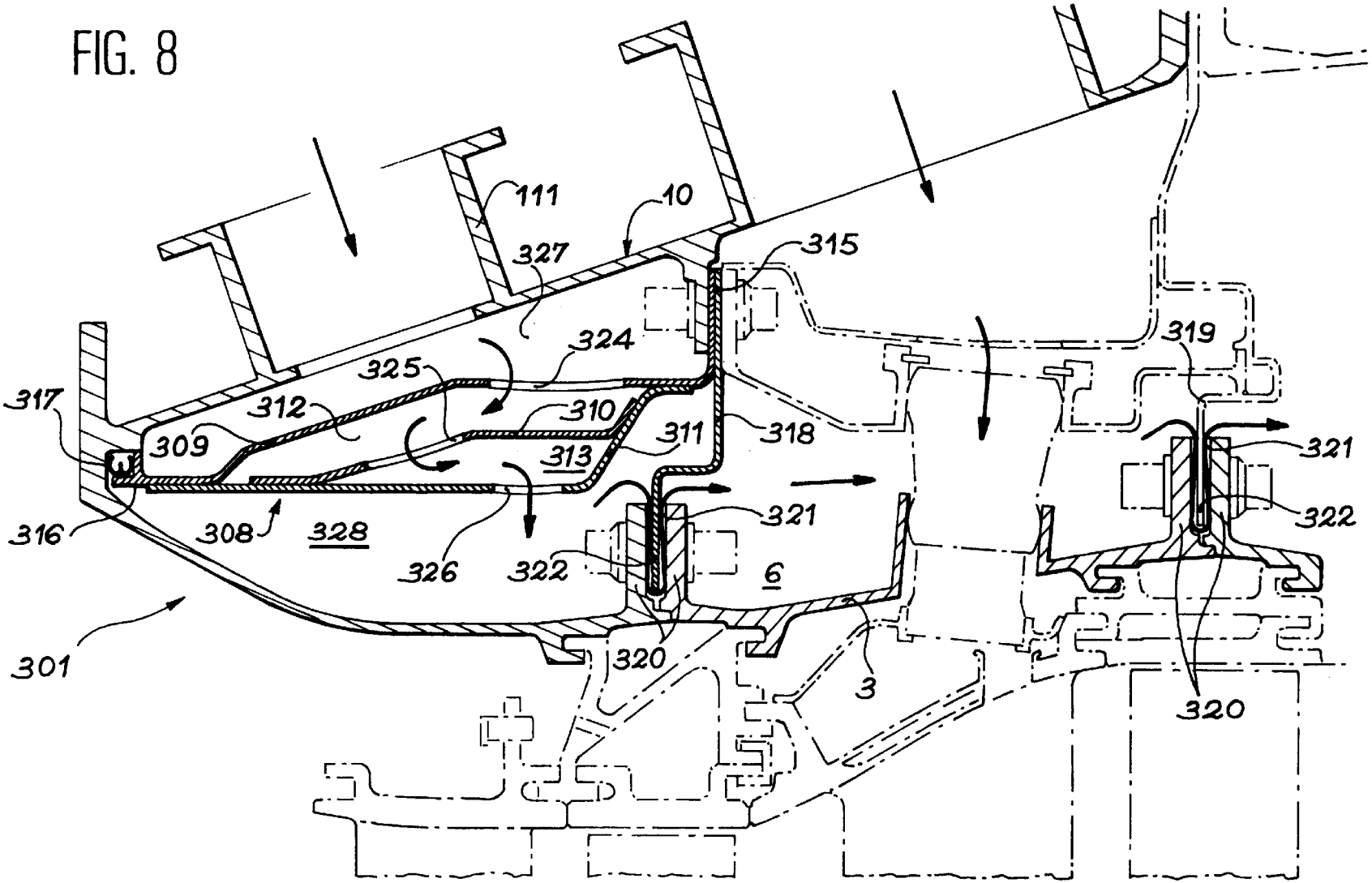
FIG. 8 A fourth construction.
Figure 9:
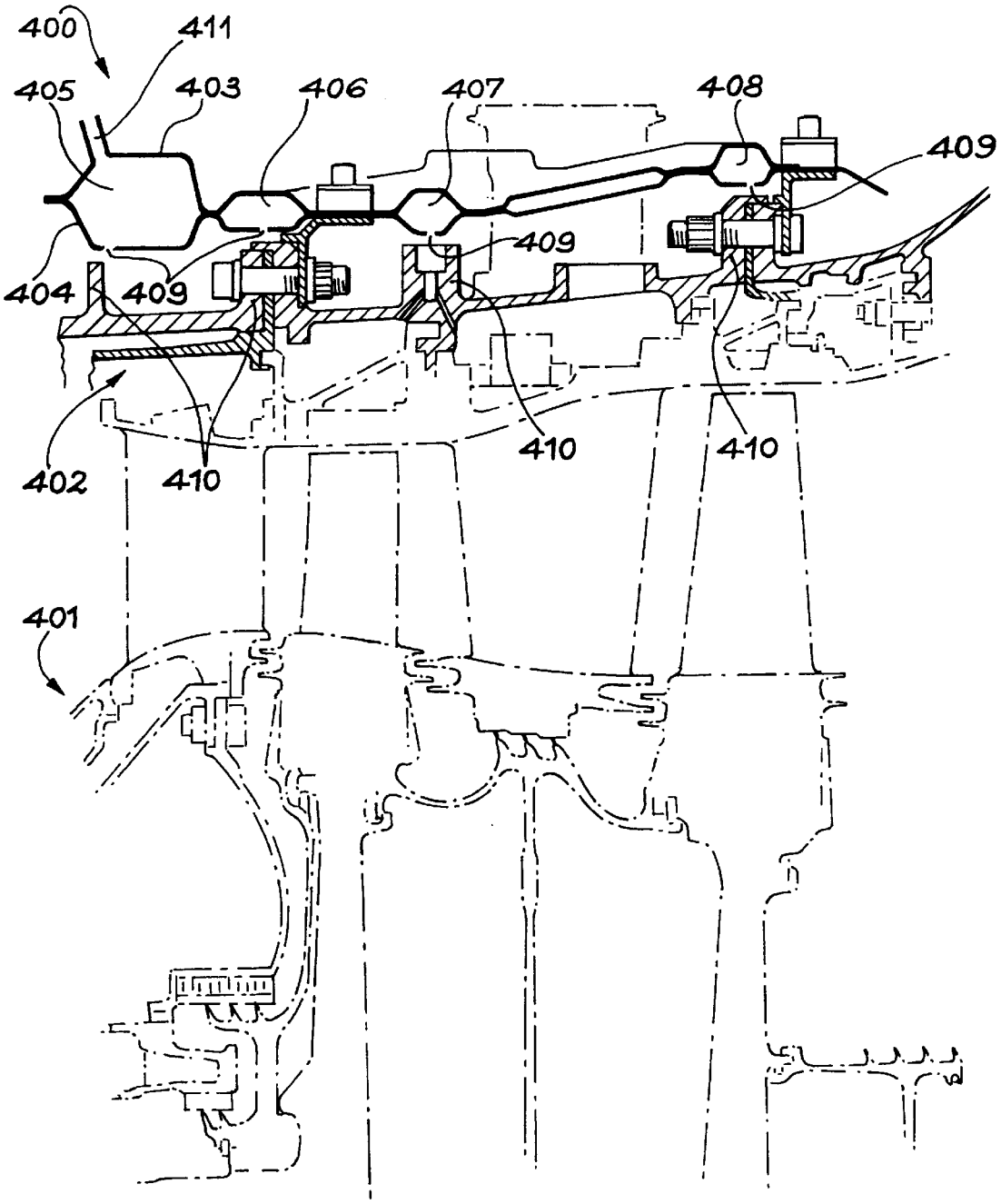
FIG. 9 A fifth construction.

Another remarkable construction is shown in FIG. 8. There is an outer casing 10 to which lead supply pipes 111, as well as a single ring 3 in a stator 301 and a mixer 308 in the intermediate volume. This mixer 308 is formed from fairings, as in the preceding construction, but on this occasion the gas flow through the mixer 308 is not substantially axial, but instead remains centripetal. Thus, the mixer 308 is formed by a laminated fairing, constituted by three successive layers 309, 310, 311 of the outer casing 10 with respect to the stator 301, said layers joining at the ends in order to isolate two chambers 312, 313 successively traversed by the gas. The layers 309, 310, 311 are once again perforated by orifices 324, 325, 326, twice more numerous on each occasion, i.e. respectively eight, sixteen and thirty two thereof. The concentric chambers 312, 313 have a relatively longitudinally flattened shape rendering useful an elongated path produced by a staggered arrangement of the orifices in order to render uniform the flow. The orifices 324 and 326 of the extreme layers 309 and 311 are positioned downstream of the engine, whereas the orifices 325 of the intermediate layer 310 are upstream. The laminated fairing is terminated by a first edge 315 screwed to the outer casing 10 and by an opposite edge in the form of an angle section 316 receiving a toroidal metal joint 317 having an open section pressed against a circular band opposite to the outer casing 10. As a result of this arrangement once again the air coming from the pipes 11 is made to pass through the mixer 308 in order to reach the heat regulating chamber 6. In this construction, the volume between the outer casing 10 and the stator 301, outside the fairings 309 to 311, forms two extreme chambers 327, 328 which also belong to the mixer 308, because flow homogenization has also occurred there.

There are also generally transversely directed fairings 318 and 319 for isolating the chamber 6 defined by the ring 3. These fairings 318, 319 replace the walls of the preceding solutions. They are screwed by one end to the outer casing 10 and by the other between the coupling flanges 320 of adjacent elements of the stator 301. These flanges 320 leave a groove 321 between them, in the centre of which is introduced an end lunule 322 of the respective supplementary fairing 318 or 319, so that the gas can only enter the groove 321 and pass to the bottom thereof before leaving it, passing round the lunule 322 in a hairpin movement. The advantage resulting from this arrangement is that the heat exchange is facilitated, on this occasion by conducting the coupling flanges 320 to the ring 3.

The final variant relates to a mixer, whose chambers have leak orifices, which do not communicate with another of the chambers. This arrangement is useful for longer mixers and whereof each of the chambers is allocated to the cooling of a separate area of the engine. Such a design is shown in FIGS. 9 to 13, where the mixer 400 is in the form of a ring surrounding a low pressure turbine 401, whose stator 402 is to be cooled. The mixer 400 comprises two sheets 403, 404, which are shaped and joined to one another so as to surround the successive, circular chambers 405, 406, 407, 408 having a polygonal section. These chambers are all perforated by orifices 409 on their radially inner face enabling them to blow ventilating gases onto the ribs 410 on the stator 402 facing them. The mixer 400 is supplied with gas by at least one supply pipe 411. As the assembly of the mixer is easier if it is constructed as two semicircular parts, use will be made of two supply pipes if said semicircular parts remain separate when the engine is installed, namely either two supply pipes, or a single pipe if said parts are assembled with one another by joining flanges in such a way that the chambers 405 to 408 extend over a complete turn. The construction with separate parts is simpler, but less satisfactory, because a part of the machine is inadequately cooled at the junctions between the boxes of the blowing devices 400 and there can be ventilation irregularities and consequently deformations of the stator 402 between the halves of the device 400.

Figure 10:
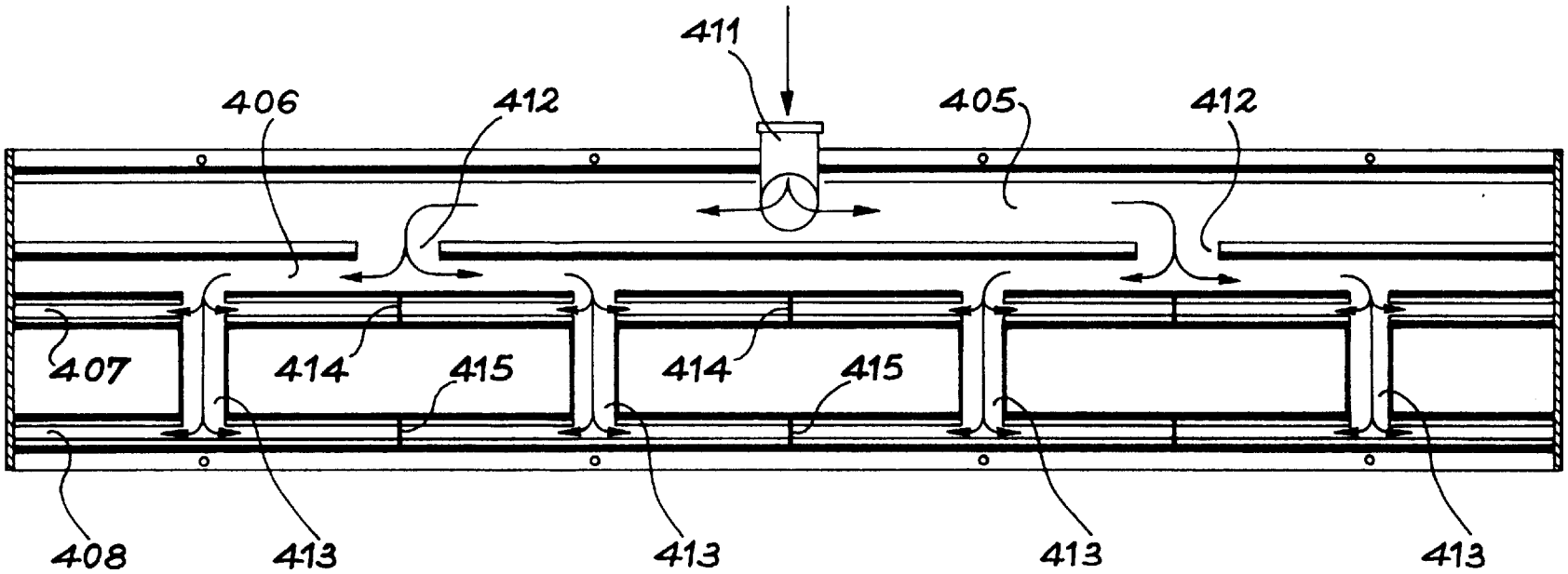
FIG. 10 A view developed on a half-turn of the mixer.

FIG. 10 shows that the principle of the preceding constructions is maintained. If there is a single supply pipe 411 joining the first chamber 405, there are two pipes 412 joining the chambers 405, 406 and four pipes 413 joining the chambers 406 to chambers 407, 408, the pipes 413 being perforated by lateral orifices 414 traversing the third chamber 407. This connection concept applies to a circular half of the blowing device 400 and is repeated for the other half. As a function of the angular extension of the chambers there can be different numbers of chambers and connection pipes.

Figure 11:
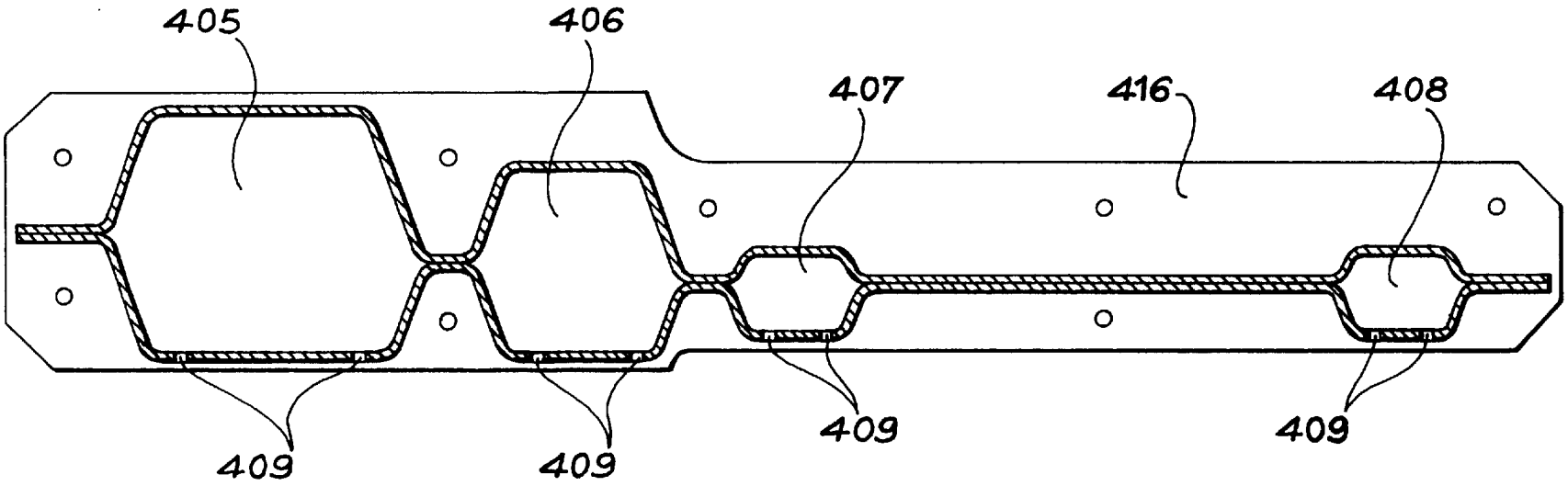
FIG. 11 A cross-section of the mixer.
Figure 12:
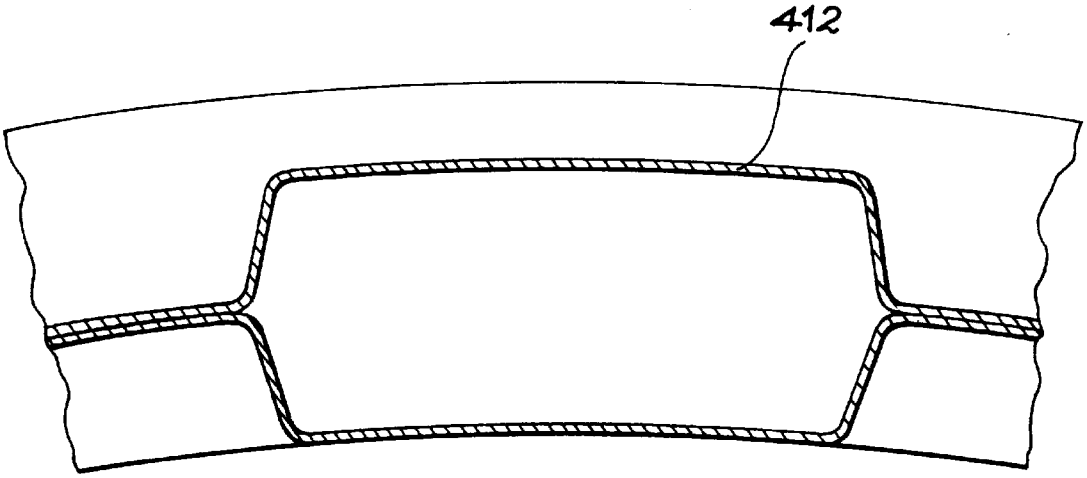
FIGS. 12 & 13 Sections of two chamber joining pipes.
Figure 13:
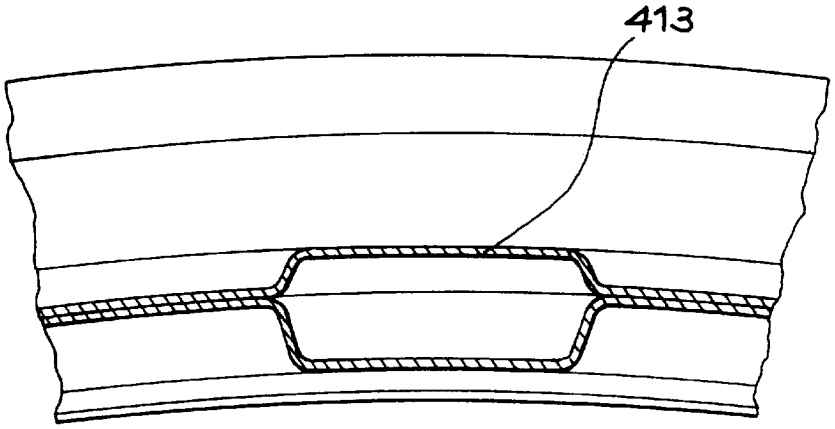

FIG. 11 shows an isolated mixer 400. It can be seen that the chambers 405 to 408 have decreasing sections, which is justified by the ever smaller gas flow rate reaching them and passing through them. FIGS. 12 and 13 show that the pipes 412 are much wider than the pipes 413, due to their smaller number and the larger flow rate passing through them.

The pipes 412, 413 serve as orifices linking the chambers of the other constructions and which are only necessary due to the spacing of the chambers in said construction.

FIG. 10 shows partitions 414, 415 respectively dividing the two last chambers 407, 408 into compartments, into each of which only issues one of the pipes 413. This arrangement also equalizes the flow rates and the ventilation blowing for each of the chambers. FIG. 11 shows one of the flanges 416 for joining to the other semicircular half of the mixer 400.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for blowing gases into an interior of a gas turbine engine extending up to a stator ring, said device comprising:

three or more succeeding chambers having identical cross-sections and defined by partitions perforated by orifices;

wherein said partitions each have a different number of orifices, and partitions with a greater number of orifices are located closer to said stator ring, said partitions serve to separate said three or more succeeding chambers, and said partitions are substantially parallel to one another.

2. The device of claim 1, wherein said number of said orifices in said partitions increases with a geometrical progression from one partition to a next partition closer to said stator ring.

3. The device of claim 2, wherein said number of said orifices in said partitions doubles from one partition to a next partition closer to said stator ring.

4. The device of claim 1, wherein said three or more succeeding chambers are annular and are separated by transverse partitions in said gas turbine engine and are in a ring form.

5. The device of claim 1, wherein said three or more succeeding chambers are substantially annular and separated by substantially cylindrical and concentric partitions.

6. The device of claim 1, further comprising:

a heat regulating chamber defined by a ring, one partition of said partitions and parallel walls joined to said ring and extending up to said one partition;

wherein said walls are perforated by discharge orifices.

7. The device of claim 1, further comprising:

a ring joined to walls perforated by sinuous orifices by which gas traverses said walls.

8. The device of claim 6, wherein said walls are formed by two parallel skins separated by a grooves.

9. The device of claim 7, wherein said three or more succeeding chambers and partitions are formed from assembled fairings.

10. The device of claim 8, wherein portions of said assembled fairings are engaged with at least one groove of said grooves.

11. A device for blowing gases into a gas turbine engine extending around at least one stator ring, said device comprising:

three or more parallel successive chambers having identical extensions, decreasing cross-sections and connected by pipes;

wherein said three or more parallel successive chambers each have a different number of pipes, and chambers with a greater number of pipes are located further downstream in a gas flow direction, and said three or more parallel successive chambers are perforated by orifices facing said stator ring.

12. The device of claim 11, wherein said number of said pipes in said three or more parallel successive chambers increases in a geometrical progression from one chamber to a next chamber located further downstream in said gas flow direction.

13. The device of claim 12, wherein said number of said of pipes in said three or more parallel successive chambers doubles from one chamber to a next chamber located further downstream in said gas flow direction.

14. The device of claim 11, wherein said three or more parallel successive chambers are partitioned into areas corresponding to said number of said pipes leading to a preceding chamber, and each area communicating with a respective at least one pipe leading to said preceding chamber.

* * * * *